US008399784B2

(12) United States Patent
Osborne

(10) Patent No.: US 8,399,784 B2
(45) Date of Patent: Mar. 19, 2013

(54) APPARATUS FOR KEY ACTUATION AND ASSOCIATED METHODS

(75) Inventor: Gareth Osborne, Hampshire (GB)

(73) Assignee: Vertu Corporation Limited, Hampshire (GB)

( * ) Notice: Subject to any disclaimer, the term of this patent is extended or adjusted under 35 U.S.C. 154(b) by 201 days.

(21) Appl. No.: 12/919,755

(22) PCT Filed: Feb. 26, 2008

(86) PCT No.: PCT/EP2008/001506

§ 371 (c)(1),
(2), (4) Date: Aug. 26, 2010

(87) PCT Pub. No.: WO2009/106092

PCT Pub. Date: Sep. 3, 2009

(65) Prior Publication Data

US 2011/0000774 A1 Jan. 6, 2011

(51) Int. Cl.
*H01H 13/70* (2006.01)

(52) U.S. Cl. ..... 200/5 A; 200/341; 200/345

(58) Field of Classification Search ..... 200/5 A, 200/517, 520, 341–345; 341/22; 345/168, 345/169; 400/490–496; 455/550.1
See application file for complete search history.

(56) References Cited

U.S. PATENT DOCUMENTS

| | | | | |
|---|---|---|---|---|
| 4,523,528 | A * | 6/1985 | Hastings et al. | 109/42 |
| 4,568,798 | A * | 2/1986 | Ambros et al. | 178/18.05 |
| 4,652,841 | A * | 3/1987 | Hudspeth et al. | 333/107 |
| 5,670,759 | A * | 9/1997 | Hsu | 200/5 A |
| 6,300,582 | B1 * | 10/2001 | Huang | 200/302.2 |
| 7,555,900 | B1 * | 7/2009 | Vallance et al. | 60/528 |
| 2002/0153982 | A1 * | 10/2002 | Jones et al. | 335/220 |
| 2004/0087333 | A1 * | 5/2004 | Hutchison et al. | 455/550.1 |
| 2006/0202968 | A1 | 9/2006 | Skillman | |
| 2009/0295736 | A1 * | 12/2009 | Laurent et al. | 345/169 |

FOREIGN PATENT DOCUMENTS

| | | | |
|---|---|---|---|
| JP | 2004517451 | A | 6/2004 |
| WO | 02/054734 | A | 7/2002 |

OTHER PUBLICATIONS

Office Action received in corresponding Korean Application No. 2010-7020962, dated Sep. 21, 2011, 13 pages.

International Search Report and Written Opinion received in corresponding Patent Cooperation Treaty Application No. PCT/EP2008/001506, Feb. 12, 2009, 11 pages.

* cited by examiner

*Primary Examiner* — Michael Friedhofer
(74) *Attorney, Agent, or Firm* — Harrington & Smith

(57) ABSTRACT

An apparatus for key actuation of an electronic device comprising a linear bearing configured for transmitting user actuation, and a complementary guide portion, wherein the linear bearing and the guide portion are arranged to allow the linear bearing to move reciprocally relative to the guide portion for key activation, and wherein both the linear bearing and the guide portion comprise a material with a hardness substantially between 6 Mohrs and 10 Mohrs.

18 Claims, 8 Drawing Sheets

APPARATUS FOR KEY ACTUATION AND ASSOCIATED METHODS

TECHNICAL FIELD

The present invention relates to the field of apparatus for key actuation and associated methods. Some specific embodiments of the present invention relate to apparatus for key actuation for an electronic device. Such apparatus can be considered to be a key arrangement, or a keymat arrangement for an electronic device.

In certain circumstances, these electronic devices may be portable electronic devices, which may or may not be hand-held in use (although they may be placed in a cradle in use). Such hand-portable electronic devices include so-called Personal Digital Assistants (PDAs).

Such portable electronic devices may provide one or more audio/text/video communication functions (e.g. telecommunication, videocommunication, and/or text transmission (Short Message Service (SMS)/Multimedia Message Service (MMS)/emailing) functions), interactive/non-interactive viewing functions (e.g. web-browsing, TV/program viewing functions), music recording/playing functions (e.g. MP3 or other format and/or (FM/AM) radio broadcast recording/playing), downloading/sending of data functions, image capture function (e.g. using a (e.g. in-built) digital camera), and gaming functions

BACKGROUND

Electronic devices, such as mobile phones, PDAs, etc. generally comprise a user interface, which may be mechanical. Such mechanical user interfaces may comprise a keymat comprising a plurality of keys that overlay switching elements, the said switching elements being in communication with the circuitry of the device.

There is a requirement to provide a key actuation of the keys of such user interfaces that responds well to a user's input. In such arrangements, the user is confident from the haptic feedback provided from a key press that the device will act in a predetermined manner according to the actuated key press.

SUMMARY

According to a first aspect of the present invention there is provided an apparatus for key actuation of an electronic device comprising a linear bearing configured for transmitting user actuation, and a complementary guide portion, wherein the linear bearing and the guide portion are arranged to allow the linear bearing to move reciprocally relative to the guide portion for key activation, and wherein both the linear bearing and the guide portion comprise a material with a hardness substantially between 6 Mohrs and 10 Mohrs.

The linear bearing and the guide portion may comprise a material with a hardness substantially between 7.5 Mohrs and 10 Mohrs.

The linear bearing and the guide portion may comprise a material with a hardness substantially of 9 Mohrs.

At least one of the linear bearing and the guide portion may comprise at least one of the following materials: Moonstone; Quartz; Topaz; Corundum; Diamond.

At least one of the linear bearing and the guide portion may comprise a Corundum material, such as ruby and/or sapphire. The linear bearing may comprise ruby and the guide portion may comprise sapphire.

Such an arrangement may provide a key portion in which linear movement thereof can be restricted to particular tolerances. Such an arrangement may provide a key portion in which linear movement thereof does not substantially degrade with use.

The apparatus may be arranged such that rotational movement of the linear bearing about its longitudinal axis is substantially inhibited. The apparatus may be arranged such that tilting (i.e. movement of the longitudinal axis) is substantially inhibited. This may provide a key portion that functions with greater veracity, when compared to a key portion that is able to rotate/tilt.

The rotation may be inhibited by providing the linear bearing/guide portion with at least one restraining region. Two or more restraining regions may be provided, which may be opposing pairs of restraining regions, so as to inhibit/restrain rotation/titling. The restraining region(s) may be substantially planer edge region(s) of the linear bearing, which may be arranged to be in a substantially abutting configuration with a complementary restraining region(s) of the guide portion (e.g. facing one another).

Rotation may be substantially inhibited by provided restraining regions extending in a plane perpendicular to the longitudinal axis of the linear bearing. Titling may be substantially inhibited by providing restraining regions along the longitudinal axis, e.g. parallel to the longitudinal axis of the linear bearing.

The linear bearing restraining region and the complementary restraining region of the guide portion may be arranged to be in a substantially abutting configuration with a spacing of less than 0.25 mm.

The linear bearing restraining region and the complementary restraining region of the guide portion may be arranged to be in a substantially abutting configuration with a spacing of less than 0.1 mm.

The linear bearing restraining region and the complementary restraining region of the guide portion may be arranged to be in a substantially abutting configuration with a spacing of less than 0.05 mm.

The apparatus may be arranged such that the average spacing increases by no more than 0.01 mm per one million reciprocal operations of the linear bearing/guide portion.

Both the linear bearing and the guide portion, or regions thereof (e.g. the restraining regions), may be provided with materials with substantially the same hardness, such as 9 Mohrs, which may include materials such as ruby and sapphire.

The restraining regions may be provided by complementary flat surface regions, complementary arcuate surface regions, or complementary irregular surface regions, such as a tongue and groove arrangement, or the like.

Both the linear bearing and the guide portion may be provided with any number of restraining regions, arranged to be in substantial abutment.

Only one, some or all of the surfaces of both the linear bearing and guide portion may comprise a material with a hardness substantially between 6 Mohrs and 10 Mohrs, such as substantially between 7.5 Mohrs and 10 Mohrs (e.g. 9 Mohrs), which may be one of ruby and sapphire. The remainder of the linear bearing/guide portion may comprise another material without a hardness substantially between 6 Mohrs and 10 Mohrs, such as steel.

In such an arrangement a material with a hardness substantially between 6 Mohrs and 10 Mohrs may be deposited on one, some or all of the surfaces of the linear bearing/guide portion, such as by chemical vapour deposition, or the like.

The linear bearing/guide portion may be provided such that only the restraining regions comprise a material with a hardness of substantially between 6 Mohrs and 10 Mohrs, such as substantially between 7.5 Mohrs and 10 Mohrs (e.g. 9 Mohrs), which may be one of ruby and sapphire. In such an arrangement, the remainder of the linear bearing/guide portion may be provided by another material without a hardness substantially between 6 Mohrs and 10 Mohrs, such as steel.

The height of the restraining region(s) of the linear bearing may be substantially the same as the height of the restraining region(s) on the guide portion. The height of the restraining region(s) on the linear bearing may be more than half the height of the restraining region(s) on the guide portion, such as ¾ the height. Such arrangements may reduce titling of the linear bearing when moving reciprocally.

The apparatus may further comprise a substrate, arranged to support the guide portion. Such an arrangement may allow the guide portion to be accurately positioned during manufacture. The guide portion may be positioned within +/−0.03 mm, or within +/−0.02 mm on the substrate (e.g. +/−0.02 mm from the desired location of the guide portion(s)). Such positioning may be provided by loading the guide portion(s) into a precision machined jig, such as jig machined from a CNC machining tool. The jig may be machined from aluminium, or the like. The jig may comprise spring loaded areas, so as to minimise any gaps. The substrate may then be offered up to the guide portion. A pressure may be applied in order to fix the substrate to the guide portion(s).

The linear bearing may comprise an upper key region. Such an arrangement may allow for a key to be attached to the linear bearing, which may be attached directly or indirectly, such as via a key member. The apparatus may comprise a key, which may be a decorative key, attached to the upper key region/key member, such as by glue.

The linear bearing may comprise a lower key region. Such an arrangement may allow for a switching element to be operable by the linear movement of the linear bearing, which may be directly (e.g. direct contact thereof) or indirectly.

The lower key region may be arranged to attach to a matting, for example an elastic matting, such as a silicon matting. The matting may provide that the linear bearing returns to a starting position after it has been depressed and depressing force has been removed.

The apparatus may further comprise a switching element. The switching element may be in communication with the matting. The switching element may comprise a first electrode and a second electrode. The apparatus may be arranged such that the first electrode is moved so as to contact the second electrode when the linear bearing is depressed. Such arrangement may allow for the key actuation of an electronic device.

According to a second aspect of the present invention there is provided a keymat for an electronic device, comprising at least one apparatus according to a first aspect of the invention.

According to a third aspect of the present invention there is provided an electronic device comprising an apparatus according to the first aspect of the invention or a keymat according to the second aspect of the invention.

The device may be a mobile phone, personal digital organiser, camera, computer (e.g. laptop), multimedia player, or the like.

According to a fourth aspect there is provided a method of providing for accurate key actuation on an electronic device, comprising:

providing a linear bearing configured for transmitting user actuation;

providing a complementary guide portion;

arranging both the linear bearing and the guide portion such that the linear bearing is able to move reciprocally relative to the guide portion; and wherein both the linear bearing and the guide portion comprise a material with a hardness substantially between 6 Mohrs and 10 Mohrs.

The method may comprise providing a linear bearing and a guide portion comprising a material with a hardness substantially between 7.5 Mohrs and 10 Mohrs.

The method may comprise providing a linear bearing and a guide portion comprising a material with a hardness substantially of 9 Mohrs.

The method may comprise providing a linear bearing and a guide portion comprising a Corundum material, such as: ruby and/or sapphire. The linear bearing may comprise ruby and the guide portion may comprise sapphire.

The method may comprise providing a linear bearing/guide portion with restraining regions that are arranged to be in substantial abutment to substantially inhibit rotation/tilting.

According to a fifth aspect of the present invention there is provided a method of manufacture of an apparatus for key actuation of an electronic device comprising:

providing a linear bearing configured for transmitting user actuation;

providing a complementary guide portion;

affixing a substrate to the guide portion; and arranging the linear bearing such that it is able to move reciprocally relative to the guide portion.

The guide portion may be arranged in a jig to within a tolerance of +/−0.03 mm. The guide portion may be glued to the substrate. The substrate may be lowered onto the guide portion.

The act of providing a linear bearing and/or complimentary guide portion may comprise grinding the linear bearing/guide portion to within −/+0.02 mm of the desired dimensions.

Both the linear bearing and the guide portion may be provided by a Corundum material, such as ruby or sapphire.

The method may further comprise providing a key, which may be a decorative key. The key may be attached, directly or indirectly, to the linear bearing.

According to a sixth aspect there is provided a means for key actuation of an electronic device comprising a means for a linear bearing configured for transmitting user actuation, and a means for a complementary guide portion, wherein the means for a linear bearing and the means for a guide portion are arranged to allow the means for a linear bearing to move reciprocally relative to the means for a guide portion for key activation, and wherein both the means for the linear bearing and the means for the guide portion comprise a material with a hardness substantially between 6 Mohrs and 10 Mohrs.

The means for a linear bearing and the means for a guide portion may comprise a material with a hardness substantially between 7.5 Mohrs and 10 Mohrs.

The means for a linear bearing and the means for a guide portion may comprise a material with a hardness substantially of 9 Mohrs.

The means for a linear bearing and the means for a guide portion may comprise at least one of the following Corundum materials: ruby and sapphire. The means for a linear bearing may comprise ruby and the means for a guide portion may comprise sapphire.

According to a seventh aspect there is provided an apparatus for key actuation of an electronic device comprising a linear bearing configured for transmitting user actuation, and a complementary guide portion, wherein the linear bearing and the guide portion are arranged to allow the linear bearing to move reciprocally relative to the guide portion for key activation, and wherein the guide portion and the linear bearing comprise complementary restraining regions to substantially inhibit relative rotation/tilting of the guide portion and linear bearing.

The restraining regions may comprise a material with a hardness substantially between 6 Mohrs and 10 Mohrs, such as substantially between 7.5 Mohrs and 10 Mohrs (e.g. 9 Mohrs), which may include one of ruby and sapphire.

According to a eighth aspect of the present invention there is provided an apparatus for key actuation of an electronic device comprising a linear bearing configured for transmitting user actuation, and a complementary guide portion, wherein the linear bearing and the guide portion are arranged to allow the linear bearing to move reciprocally relative to the guide portion for key activation, and wherein both the linear bearing and the guide portion comprise a Corundum material.

According to a ninth aspect there is provided an apparatus for key actuation of an electronic device comprising a linear bearing configured for transmitting user actuation, and a complementary guide portion, wherein the linear bearing and the guide portion are arranged to allow the linear bearing to move reciprocally relative to the guide portion for key activation, and wherein both the linear bearing and the guide portion are one of ruby and sapphire and wherein the linear bearing comprises restraining regions arranged to co-operate with complementary restraining regions on the guide portion so as to restrict the movement of the linear bearing to a substantially linear direction, and wherein the restraining regions of the linear bearing and the complementary restraining regions of the guide portion abut with a spacing of around 0.1 mm, or less.

The present invention includes one or more corresponding aspects, embodiments or features in isolation or in various combinations whether or not specifically stated (including claimed) in that combination or in isolation. Corresponding means for performing one or more of the discussed functions are also within the present disclosure.

The above summary is intended to be merely exemplary and non-limiting.

BRIEF DESCRIPTION OF THE FIGURES

A description is now given, by way of example only, with reference to the accompanying drawings, in which:—

DETAILED DESCRIPTION OF THE FIGURES

Figure 1:
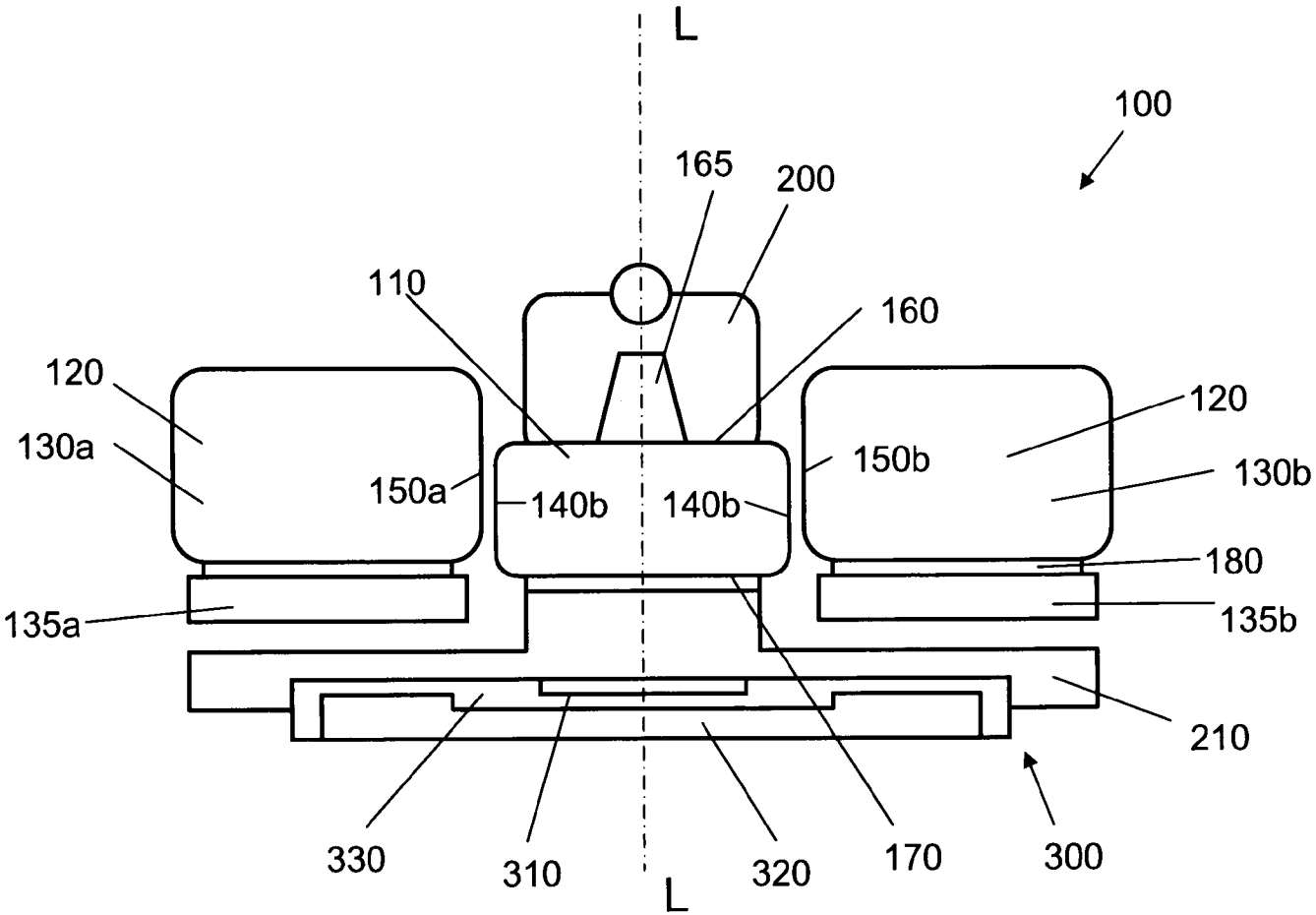
FIG. 1 shows a cross-section of an apparatus for key actuation of an electronic device according to a first embodiment.
Figure 2B:
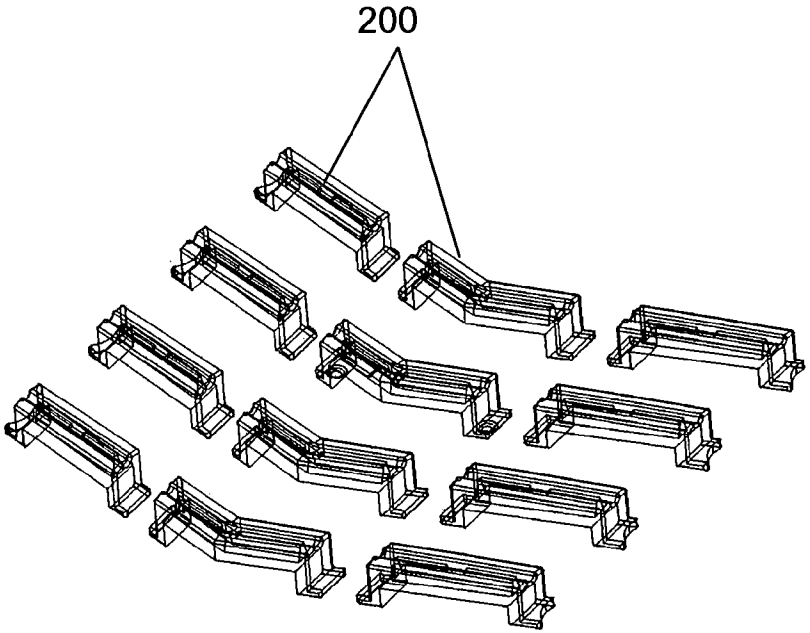
FIGS. 2*a-d* show wireframe arrangements of components of a keymat.
Figure 2A:
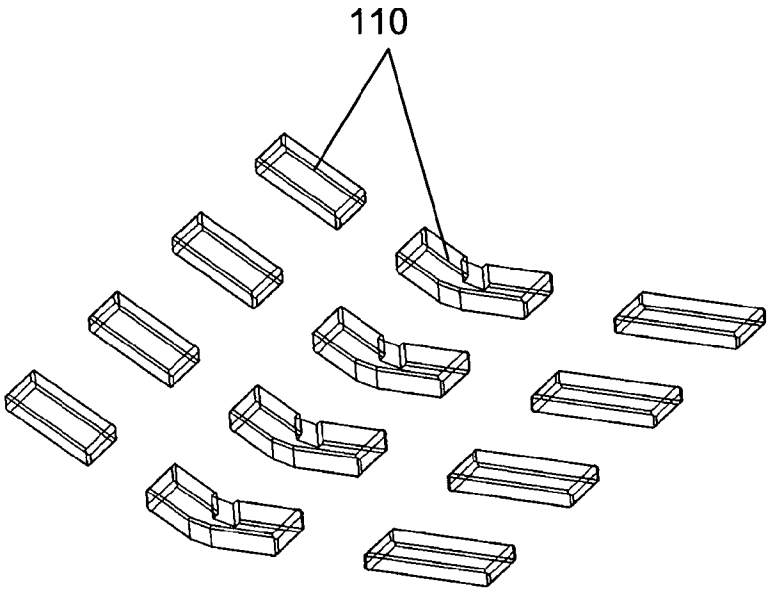
Figure 2D:
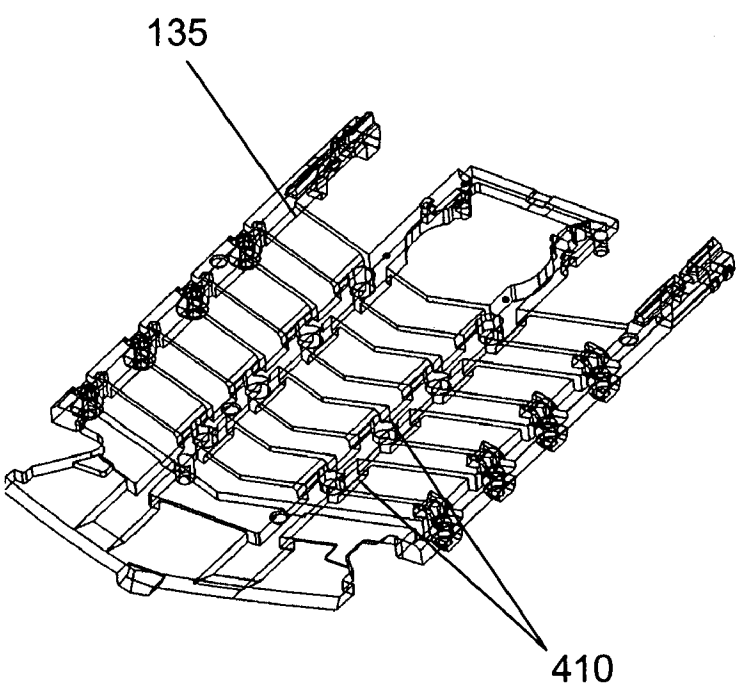
Figure 2C:
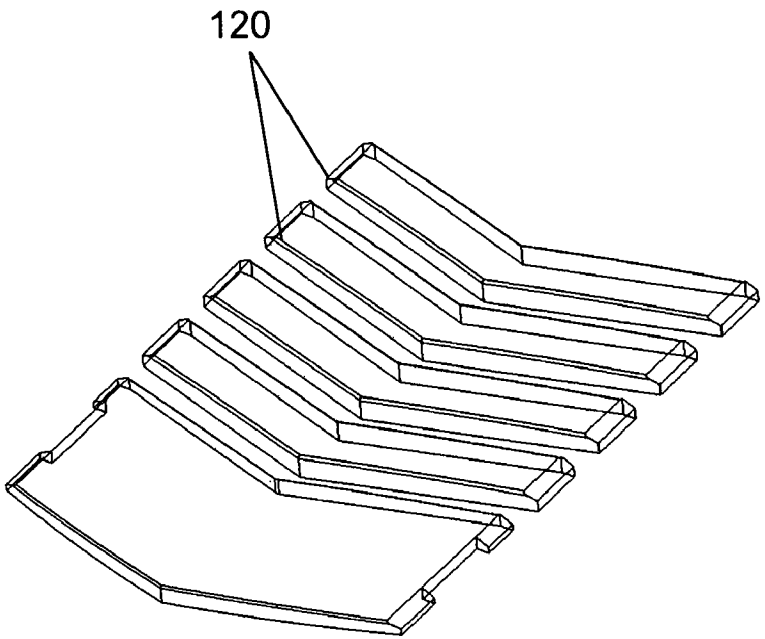
Figure 2E:
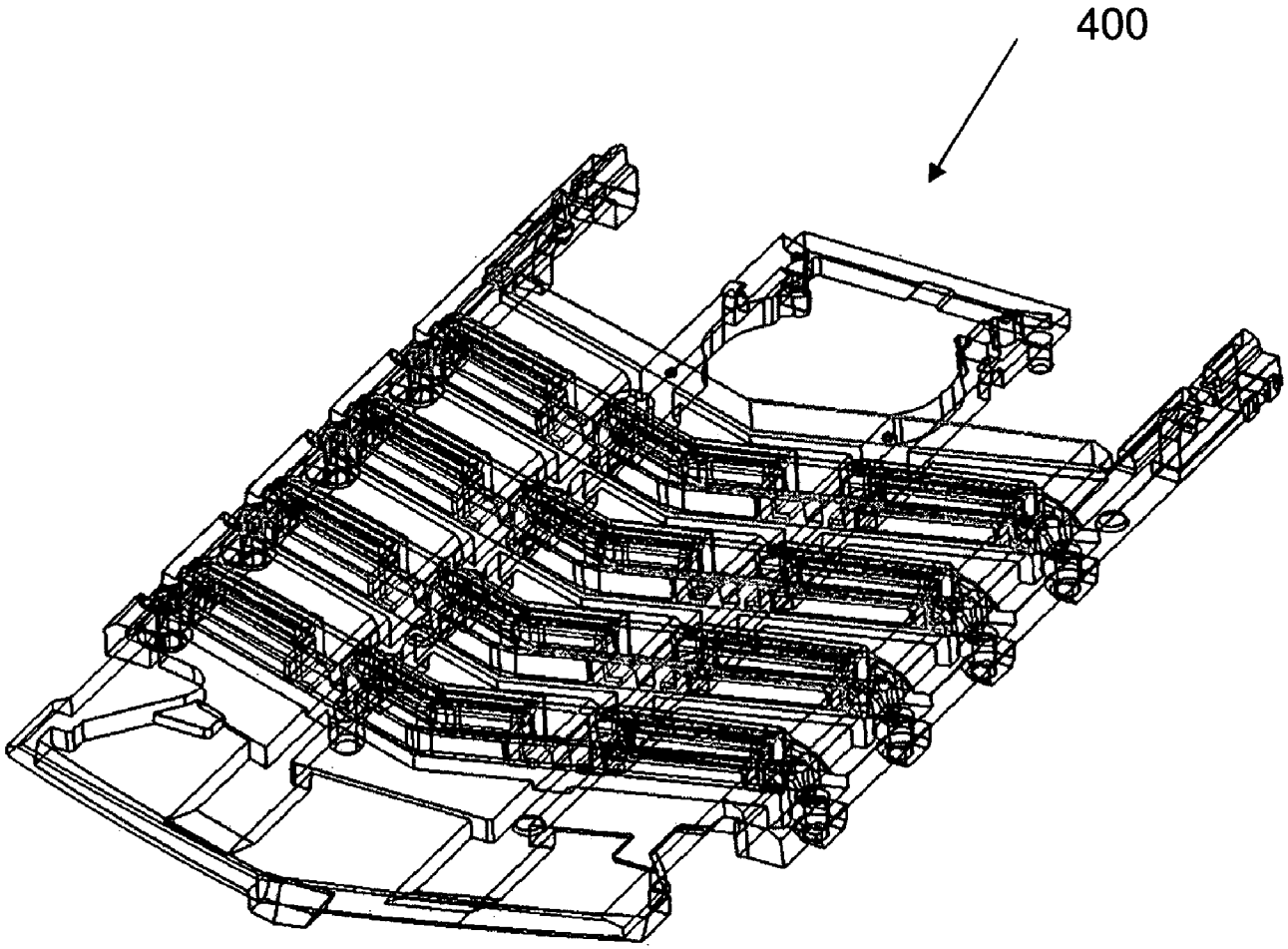
FIG. 2*e* shows an isometric wireframe figure of the combined keymat.
Figure 2F:
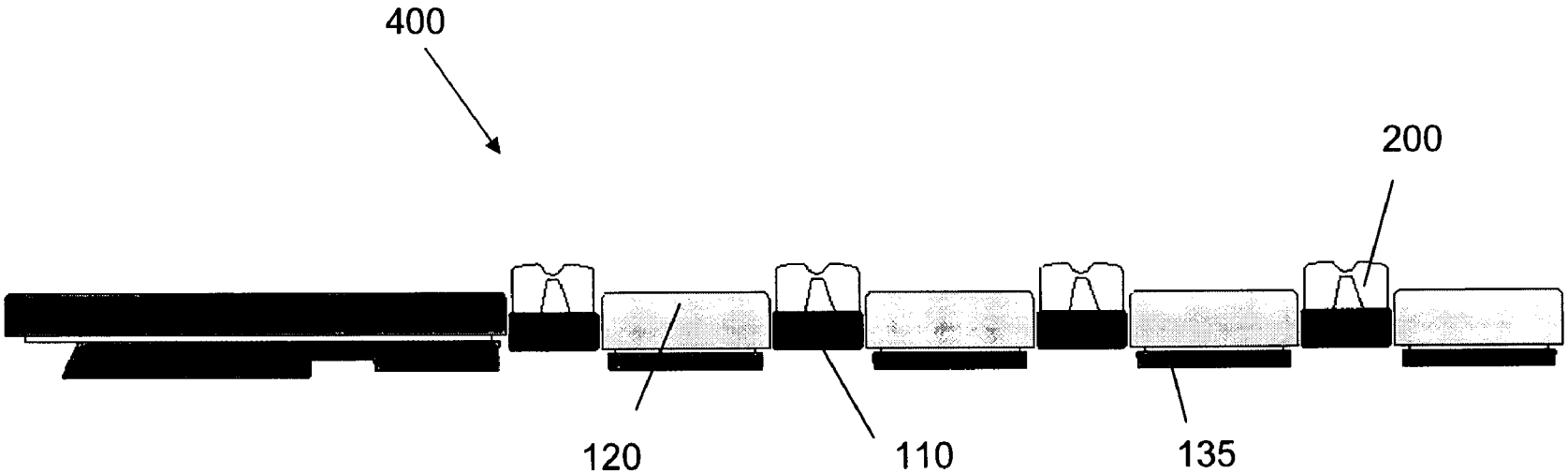
FIG. 2*f* shows a cross-section thereof.

FIG. 1 shows a cross-sectional view of an apparatus 100 for key actuation for an electronic device. The apparatus 100 comprises a linear bearing 110 and a guide portion 120. In the present embodiment, the guide portion 120 comprises a first guide 130*a* and a second guide 130*b*. The first guide 130*a* and the second guide 130*b* are arranged either side of the linear bearing 110. In this embodiment, the first and second guides 130*a*, 130*b* are separate (i.e. not joined), but in other arrangements the first/second guides 130*a*, 130*b* may, for example, form two sides of they same guide portion (e.g. a ring), which in cross-section only appear separate.

Both the first and the second guide 130*a*, 130*b* are supported by a substrate 135, which in the present embodiment is shown as a first and second substrate, 135*a*, 135*b*, respectively. Both the first and second guide 130*a*, 130*b* are affixed to the substrates, 135*a*, 135*b*, by an affixing layer 180, which in the present embodiment is glue. In the present embodiment the width of each substrate 135*a*, 135*b* is less than the width of the corresponding first and second guide 130*a*, 130*b*, so as not to interfere with the linear bearing/guide portion in use (as will be described in further detail below). However, in alternative embodiments this need not be the case.

In the present embodiment, both the linear bearing 110 and the guide portion 120 consist of materials that exhibit a hardness of substantially between 6 and 10 Mohrs, such as that provided by Corundum materials, which has a hardness of substantially 9 Mohrs. In the present embodiment, the linear bearing 110 is a ruby material, while the first and second guides 130*a*, 130*b* are sapphire materials. In alternative embodiments, both the linear bearing 110 and the guide portion 120 may be other materials that exhibit a hardness of substantially between 6 and 10 Mohrs. For example, such materials may include Moonstone, Quartz, Topaz, Diamond, Tungsten, or the like (Tungsten having a hardness of substantially 7.5 Mohrs). It will readily be appreciate by the skilled reader that in further embodiments the linear bearing 110 and the first and second guide, 130*a*, 130*b* may be any of those materials. The materials may be precious materials (or alloy thereof) with sufficient hardness. The materials may be crystalline, or polycrystalline or the like, e.g. sintered.

The linear bearing 110 has two restraining regions 140*a*, 140*b*, which in the present embodiment extend for substantially the height of the linear bearing 110. In the present embodiment, the restraining regions 140, 140*b* are provided by substantially planer edge regions (i.e. flat surfaces extending into and perpendicular to the Figure). In alternative embodiments however the restraining regions 140*a*, 140*b* may be provided by arcuate, or irregular surface regions, or the like.

Both the first and second guide 130*a*, 130*b* have complementary restraining regions 150*a*, 150*b* (i.e. provided by substantially complementary planer edge regions). Both the complementary restraining regions 150*a*, 150*b* extend for substantially the height of the first and second guide 130*a*, 130*b*. In the present embodiment the complementary restraining region 150*a* of the first guide 130*a* is arranged to face one restraining region 140*a* of the linear bearing 110, while the other complementary restraining region 150*b* of the second guide 130*b* is arranged to face the other restraining region 140*b* of the linear bearing. In the present embodiment, each restraining region 140*a*, 150*a*, and 140*b*, 150*b* are separated by a very small spacing (e.g. a spacing of in the region of 0.05 mm). Therefore if two of the restraining regions (i.e. 140*a* and 150*a*, or 140*b* and 150*b*) are substantially in contact (i.e. physically touching) a spacing of approximately 0.1 mm is provided between the other two restraining regions. Given the very small spacing (at rest and in use), the restraining regions 140*a*, 150*a*, 140*b*, 150*b* could be considered to be in substantial abutment, or substantially abutting.

It will readily be appreciated that in alternative embodiments the restraining regions 140*a*, 140*b*, 150*a*, 150*b* need not extend for substantially the height of either the linear bearing 110, or the first or second guide 130*a*, 130*b*, and may extend for only a portion thereof.

The height of each of the complementary restraining regions 150*a*, 150*b* is larger than the height of the restraining regions 140*a*, 140*b* of the linear bearing 110. In the present embodiment, the complementary restraining regions are roughly four thirds (4/3) the height of the restraining regions of the linear bearing. It will readily be appreciated that, in alternative embodiments, the heights need not differ in such a manner. In alternative embodiments the height of the restraining regions 140*a*, 140*b* of the linear bearing 110 may be more than 4/3, such as 5/3, 2/1, 4/1, or any ratio therebetween, or the like.

In the present embodiment, the width of the linear bearing 110 (i.e. substantially the spacing between the first and second guide 130*a*, 130*b*) is arranged to be 2.5 times greater than the height of the restraining regions 140*a*, 140*b* of the linear bearing 110. In alternative embodiments the width of the linear bearing 110 is arranged to be 2 times greater, may be arranged to be more than 2, and 2.5 times, such as 3, 4, 6, 10, or any number therebetween.

The linear bearing 110 further comprises an upper key region 160 and a lower key region 170. The upper key region 160 comprises a key member 165. The key member 165 is arranged substantially equidistant between the first guide 130*a* and the second guide 130*b*. The key member 165 is arranged to allow attachment of a key 200, such as a decorative electronic device key, thereto. In the present embodiment an attached key 200 extends beyond the height of the first and second guide 130*a*, 130*b*.

The lower key region 170 is in communication with a matting 210, which in the present embodiment is a silicon matting 210. In the present embodiment, the lower key region 170 is attached to the matting 210, such as by glue. The matting 210 is arranged such that it extends between the first and second substrate 135*a*, 135*b*, and is in communication with a switching element 300. The switching element 300 comprises a first electrode 310 and a second electrode 320, which in the present embodiment are spaced by a clearance distance 330. Both the first and the second electrode 310, 320 are arranged to be in communication with an electronic device (not shown). The first and second electrodes 310, 320 are arranged to provide electrical continuity when substantially brought together, such as by making contact.

In use, a user may depress the key 200. This causes the linear bearing 110 to move in a linear fashion substantially along its longitudinal axis L, guided by the guide portion 120, and restrained by the restraining regions, e.g. so as not to substantially tilt (i.e. the longitudinal axis L stays substantially perpendicular to the matting 210) or rotate (i.e. the linear bearing does not substantially rotate about its longitudinal axis L). As the linear bearing 110 moves, the matting 210 is depressed. In this arrangement, this matting 210 is elastically depressed. This depression causes an actuating force to act upon the first electrode 310. The first electrode 310 therefore moves and comes into electrical contact with the second electrode 320.

It will be appreciated that two opposing pairs of appropriately configured restraining regions 140*a*, 150*a* and 140*b*, 150*b* would be particularly useful at restraining tilting/rotating of the linear bearing 110.

When the user removes the force depressing the key 200, the matting 210 wishes to return elastically to its original position. This causes the linear bearing 110 to move in a linear fashion, guided by the guide portion 120 in a reciprocal manner (i.e. in a reverse direction). In such an arrangement the actuation of the keys of such user interfaces responds well to a users input, and the haptic response is satisfying, (e.g. there is no rolling of the linear bearing, or wear on the apparatus caused by use).

FIG. 2 shows a keymat 400 arrangement comprising a plurality of apparatus 100 for key actuation for an electronic device. In this arrangement the electronic device is a mobile telephone. FIG. 2*a* shows a plurality of linear bearings 110, arranged in a user interface arrangement. FIG. 2*b*, shows a plurality of keys 200, arranged in a user interface arrangement. FIG. 2*c* shows a plurality of guide portions 120, arranged in a user interface arrangement, and arranged to be in a complementary arrangement with the linear bearings 110. FIG. 2*d* shows a substrate 135, arranged in a user interface arrangement, and arranged to support the guide portions 120. FIG. 2*e* shows an isometric projection of a combination of FIGS. 2*a* to 2*d*. In this arrangement the linear bearings 110 are abutted on two adjacent sides by guide members 120. A portion of extended substrate 410 extends between adjacent linear bearings 110 so as to locate them in position. FIG. 2*f* shows a cross-sectional arrangement of a FIG. 2*e*. For clarity, the matting(s) 210 and the switching element(s) 300 are not shown in this arrangement.

Figure 3:
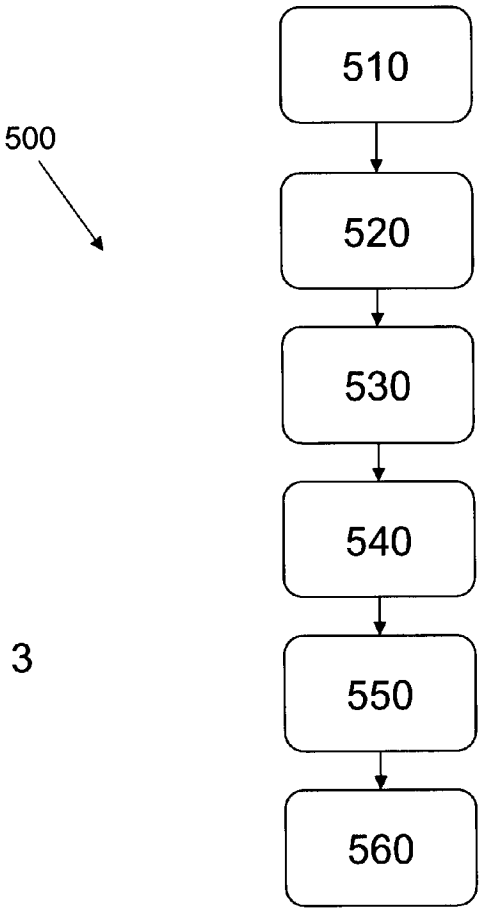
FIG. 3 shows a flow chart of a method of manufacture of an apparatus/keymat.

FIG. 3 shows a flow chart 500 indicating the steps in making the keymat 400 of FIG. 2. In a first step 510, the linear bearing(s) and the guide portion(s) are grown as crystalline materials. In a second step 520, the linear bearing(s) and the guide portion(s) are ground (e.g. by diamond grinding), to within +/−0.02 mm of their desired dimensions. In a third step 530, the keys 200 are affixed by glue to the linear bearings 110. In a fourth step 540, the guide portions 120 are positioned in a jig, such that their position is located to within +/−0.03 mm of their desired location. In a fifth step 550, the substrate 135 is affixed to the positioned guide portions 120. In a sixth step 560, the keymat 400 is assembled. It will be readily appreciated by the skilled reader that the above steps are not limited in order and may be implemented in an alternative order, such as conducting the fourth step 540, prior to the third 530.

Figure 4B:
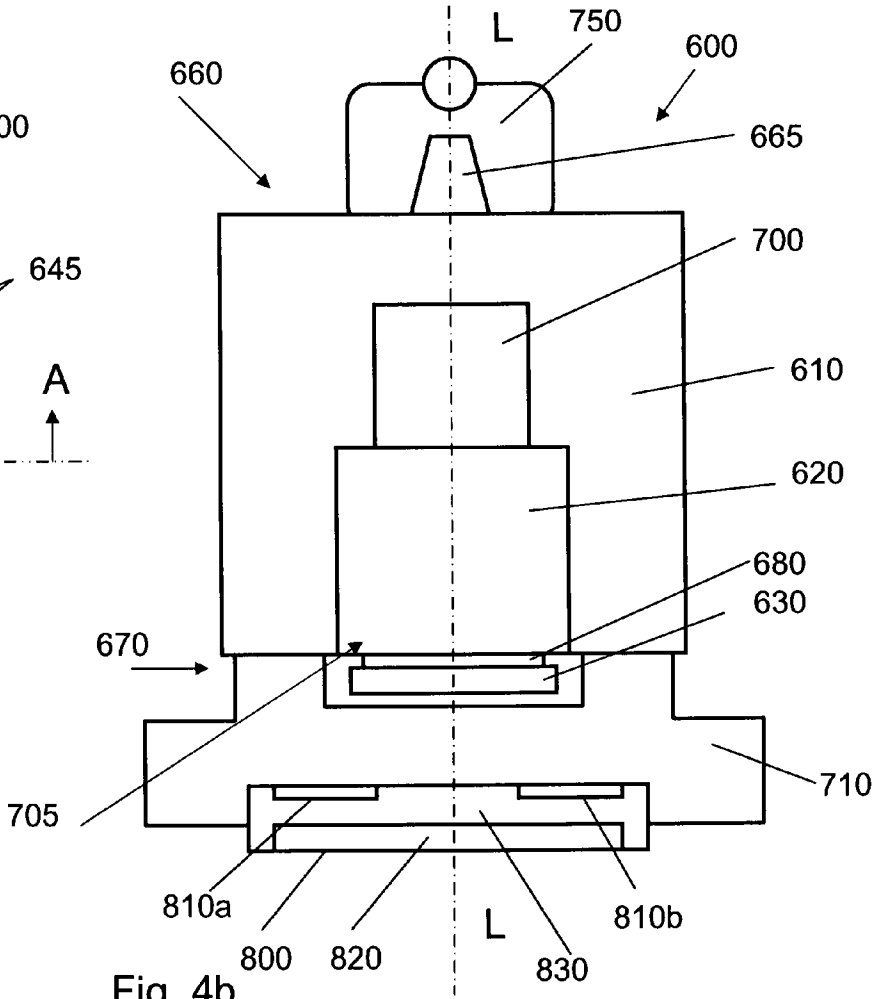
FIG. 4 shows a further embodiment of an apparatus for key actuation for an electronic device.
Figure 4A:
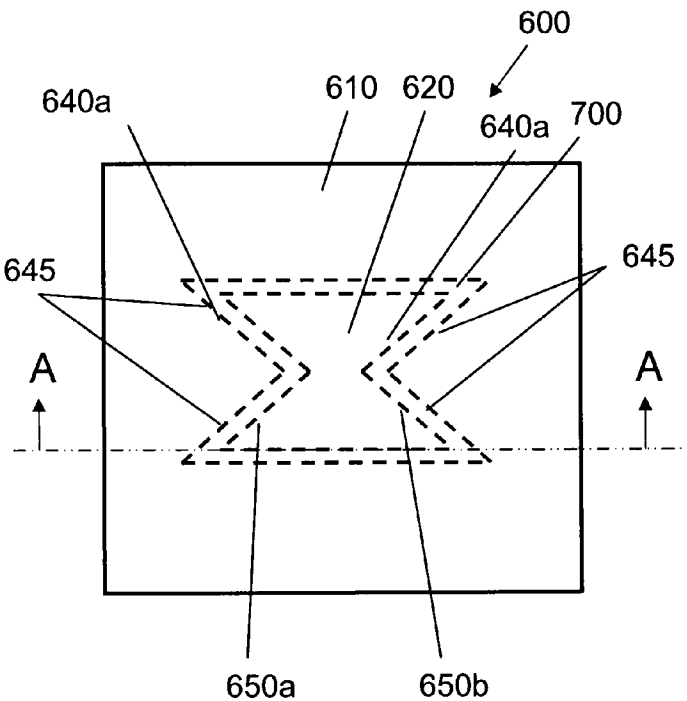
Figure 5B:
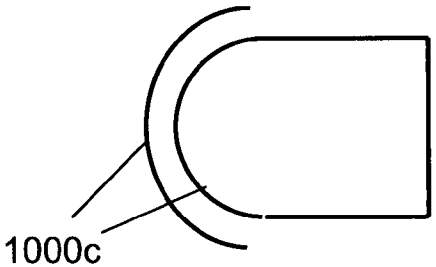
FIG. 5 shows further arrangements of restraining regions of apparatus for key actuation for an electronic device.
Figure 5A:
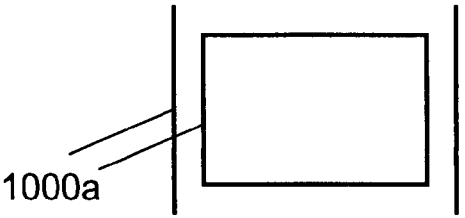
Figure 5D:
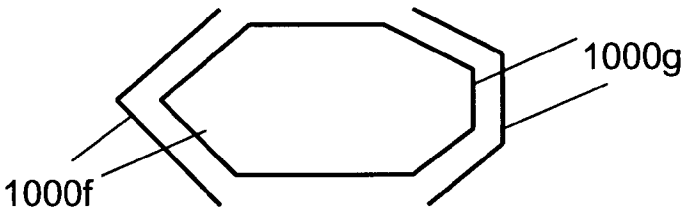
Figure 5C:
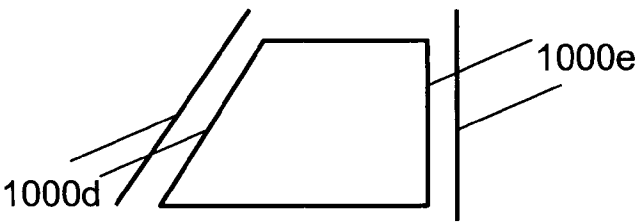

FIG. 4 shows a further embodiment of the present invention. FIG. 4*a* shows a plan view and FIG. 4*b* shows a cross-section through A-A of FIG. 4*a* in which an apparatus 600 for key actuation for an electronic device is shown. In contrast to the embodiment of FIG. 1, a linear bearing 610 surrounds a substantially centrally located guide portion 620. In the present embodiment the linear bearing 610 is provided with a cavity region 700, which is open at a lower end region 705 of the linear bearing 610. The cavity region 700 is arranged to extend for substantially three quarters (¾) of the height of the linear bearing 610. In alternative embodiments, the cavity region 700 may extend for any other height, which may be the full height of the linear bearing 610. In the present embodiment, a portion of the guide portion 620 is arranged to sit within the cavity region 700 of the linear bearing 610.

The guide portion 620 is arranged on a substrate 630 and is affixed by an affixing layer 680, which in the present embodiment is glue. The width of the substrate 630 is less than the width of the guide portion 620.

Both the linear bearing 610 and the guide portion 620 consist of materials that exhibit a hardness of substantially between 6 and 10 Mohrs, such as that provided by Corundum materials, which have a hardness of substantially 9 Mohrs. In the present embodiment the linear bearing 610 is a ruby material, while the guide portion 620 is a sapphire material. In alternative embodiments both the linear bearing 610 and the guide portion 620 may be other materials that exhibit a hardness of substantially between 6 and 10 Mohrs For example, such materials may include Moonstone, Quartz, Topaz, Diamond, Tungsten, or the like (Tungsten having a hardness of substantially 7.5 Mohrs). It will readily be appreciate by the skilled reader that in further embodiment the linear bearing 610 and the guide portion 620 may be any of those materials. The materials may be other precious materials (or alloy thereof) with sufficient hardness. The materials may be crystalline, or polycrystalline or the like, e.g. sintered.

The recess portion 700 of the linear bearing 610 has two restraining regions 640*a*, 640*b*, which, in the present embodiment, extend for substantially the height of the recess portion 700 of the linear bearing 610. In the present embodiment, each restraining region 640*a*, 640*b* is provided by two planer extending surfaces 645, which extend into the recess portion 700, and that adjoin at a point. In alternative embodiments however, the restraining regions 640*a*, 640*b* may be provided such that they extend into the linear bearing 610 (i.e. the inverse of the present embodiment), or are provided by arcuate, or irregular surfaces regions, or the like.

The guide portion 620 is provided with two complementary restraining regions 650*a*, 650*b*, which extend for substantially the height of the guide portion 620. Therefore the two complementary restraining regions 650*a*, 650*b* extend into the guide portion 620. In the present embodiment the complementary restraining regions 650*a*, 650*b* are arranged to face the restraining regions 640*a*, 640*b* of the linear bearing 610. Each of the complementary restraining regions 640*a*, 640*b*, 650*a*, 650*b* are separated by a very small spacing, e.g. in the region of 0.05 mm. Therefore if two restraining regions (i.e. 640*a*, 650*a*, and 640*b* and 650*b*) 17are substantially in contact (i.e. physically touching) a spacing of approximately 0.1 mm is provided between the other two restraining regions. Given the very small spacing (when in use and at rest), the restraining regions 640*a*, 650*a* 640*b*, 650*b* could be considered to be in substantial abutment or substantially abutting.

The height of each of the complementary restraining region 650*a*, 650*b* is smaller than the height of the restraining region 640*a*, 640*b* of the linear bearing 610. In the present embodiment, the complementary restraining regions 650*a*, 650*b* of the guide portion 620 are roughly four thirds (4/3) the height of the restraining regions 640*a*, 640*b* of the linear bearing 610. It will readily be appreciated that, in alternative embodiments, the height need not differ in such a manner.

In the present embodiment, the linear bearing 610 further comprises an upper key region 660 and a lower key region 670. The upper key region 660 comprises a key member 665. The key member 665 is arranged so as to be substantially concentric with the central axis of the guide portion 620, i.e. axis L. The key member 665 is arranged to allow attachment of a key 750, such as a decorative electronic device key, thereto.

The lower key region 670 is in communication with a matting 710, which in the present embodiment is a silicon matting 710. The lower key region 670 is attached to the matting 710 by an attachment layer 680, such as by glue 680. The silicon matting 710 is arranged such that it extends on two lower side regions of the lower key region 670. In this arrangement, the matting 710 is in communication with a switching element 800. The switching element 800 comprises two first electrodes 810*a*, 810*b* and a second electrode 820, which in the present embodiment are spaced by a clearance distance 830. The two first electrode 810*a*, 810*b*, are arranged such that they are positioned under a portion of the linear bearing 610 (i.e. substantially not under the recess portion 700).

The two first and the second electrodes 810*a*, 810*b*, 820 are arranged to be in communication with an electronic device (not shown). The two first and second electrodes 810*a*, 810*b*, 820 are arranged to provide electrical continuity when substantially either the first first electrode 810*a* or the second first electrode 810*b* is brought together with the second electrode 820*b*, so as to make contact.

In use, a user may depress the key 750. This causes the linear bearing 610 to move in a linear fashion substantially along its longitudinal axis L, guided by the guide portion 620, and restrained by the restraining regions 640*a*, 640*b*, 650*a*, 650*b*, e.g. so as not to substantially tilt (i.e. the longitudinal axis stays substantially perpendicular to the matting 210) or rotate (i.e. the linear bearing 610 does not substantially rotate about its longitudinal axis. As the linear bearing 610 moves, the matting 800 is depressed. In this arrangement, this matting 800 is elastically depressed. This depression causes an actuating force to act upon the at least one of the two first electrodes 810*a*, 810*b*. One of the two first electrodes 810, 810*b* therefore moves and comes into electrical contact with the second electrode 820.

When the user removes the force depressing the key 750, the matting 800 wishes to return elastically to its original position. This causes the linear bearing 610 to move in a linear fashion guided by the guide portion 620, and restrained by the restraining regions 640*a*, 640*b*, 650*a*, 650*b*, in a reciprocal manner (i.e. in a reverse direction from above). During such reciprocal movement the linear bearing 610 tilting and rotational movement (e.g. when a user applies an acute force to a key 750), is reduced due to the restraining regions 640*a*, 640*b*, 650*a*, 650*b*. In such an arrangement the actuation of the keys 750 of such user interfaces responds well to a users input, and the haptic response is satisfying, (e.g. there is no rolling of the linear bearing, or wear on the apparatus).

Again it will be appreciated that two opposing pairs of appropriately configured restraining regions 640*a*, 650*a*, 640*b*, 650*b* would be useful in restraining tiling/rotation.

It will readily be appreciated that the above embodiment may be incorporated into a keymat/device in a similar manner to that given above for the first embodiment. Similarly, that any of the features of the second embodiment may be incorporated into the first embodiment and visa versa.

In addition it will readily be appreciated that the that the linear bearing 110, 610 and/or guide portion 120, 620 may comprise any number of restraining regions 140*a*, 140*b*, 150*a*, 150*b*, 640*a*, 640*b*, 650*a*, 650*b*, such as 1, 3, 6, 10, 20 or any number therebetween. Each restraining region 140*a*, 140*b*, 150*a*, 150*b*, 640*a*, 640*b*, 650*a*, 650*b* may be provided on adjacent, opposing and/or irregular edge regions of the linear bearing 110, 610 and/or the guide portion 120, 620, which act to restrain the aforementioned rotation/tilting.

FIG. 5 shows a plan view of some further arrangements of restraining regions 1000. FIG. 5*a* shows a parallel opposing pair of restraining regions 1000*a*, 1000*b*. FIG. 5*b* shows a single arcuate restraining region 1000*c*. FIG. 5*c* shows a non-parallel opposing pair of restraining regions 1000*d*, 1000*e*. FIG. 5*d* shows a two irregular pairs of restraining regions 1000*f*, 1000*g*.

It will be appreciated that the aforementioned apparatus may have other functions in addition to the mentioned functions, and that these functions may be performed by the same apparatus.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. An apparatus for key actuation of an electronic device, the apparatus comprising:

a linear bearing configured for transmitting user actuation; and a complementary guide portion, wherein the linear bearing and the guide portion are configured such that the linear bearing is able to move reciprocally relative to the guide portion to allow for key actuation, and wherein both the linear bearing and the guide portion comprise a material with a hardness substantially between 7.5 Mohs and 10 Mohs.

2. An apparatus according to claim 1, in which the linear bearing and the guide portion comprise a material with a hardness substantially of 9 Mohs.

3. An apparatus according to claim 1, wherein at least one of the linear bearing and the guide portion comprises at least one of the following:

a corundum material, ruby, and sapphire.

4. An apparatus according to claim 3 in which the linear bearing comprises ruby and the guide portion comprises sapphire.

5. An apparatus according to claim 1, wherein the linear bearing and the guide portion comprise at least one restraining region each to define at least one pair of restraining regions configured to substantially inhibit relative rotation and/or tilting between the linear bearing and the guide portion.

6. An apparatus according to claim 5 in which the at least one pair of restraining regions are provided by substantially planar edge regions.

7. An apparatus according to claim 5 in which the at least one pair of restraining regions are configured to be in substantial abutment.

8. An apparatus according to claim 5, in which both the at least one restraining region(s) of the linear bearing and the at least one restraining region(s) of guide portion comprise materials with substantially the same hardness.

9. An apparatus according to claim 5 in which both the linear bearing and the guide portion are provided with a plurality of restraining regions, configured to be in substantial abutment.

10. An apparatus according to claim 9, in which one of: one, some and all of the surfaces of both the linear bearing and guide portion comprise a material with a hardness substantially between 6 Mohs and 10 Mohs.

11. An apparatus according to claim 5 in which only the restraining regions comprise a material with a hardness substantially between 6 Mohs and 10 Mohs.

12. An apparatus according to claim 1, wherein the linear bearing comprises an upper key region configured to allow for a key to be attached.

13. An apparatus according to claim 1, wherein which the linear bearing comprises a lower key region, arranged to allow for a switching element to be operable by linear movement of the linear bearing.

14. An apparatus according to claim 13 in which the lower key region is attached to a matting, the matting configured such that the linear bearing returns to a starting position after it has been depressed and the depressing force has been removed.

15. An apparatus according to claim 14 in which the apparatus further comprises a switching element configured to be in communication with the matting such that depression of the linear bearing causes a first electrode of the switching element to be moved to contact a second electrode of the switching element.

16. An apparatus according to claim 1, wherein the apparatus is provided in one or more of:

a keymat for an electronic device, and an electronic device.

17. A method of providing for accurate key actuation on an electronic device, the method comprising:

providing a linear bearing configured for transmitting user actuation;

providing a complementary guide portion;

configuring both the linear bearing and the guide portion such that the linear bearing is able to move reciprocally relative to the guide portion to allow for key actuation; and wherein both the linear bearing and the guide portion comprise a material with a hardness substantially between 7.5 Mohs and 10 Mohs.

18. A method of manufacture of an apparatus for key actuation of an electronic device, the method comprising:

providing both a linear bearing, configured for transmitting user actuation, and a complementary guide portion of an apparatus such that the linear bearing is able to move reciprocally relative to the guide portion to allow for key actuation of an electronic device, wherein both the linear bearing and the guide portion comprise a material with a hardness substantially between 7.5 Mohs and 10 Mohs.

* * * * *